US006731492B2

(12) United States Patent
Goodwin-Johansson

(10) Patent No.: US 6,731,492 B2
(45) Date of Patent: May 4, 2004

(54) OVERDRIVE STRUCTURES FOR FLEXIBLE ELECTROSTATIC SWITCH

(75) Inventor: Scott H. Goodwin-Johansson, Pittsboro, NC (US)

(73) Assignee: MCNC Research and Development Institute, Research Triangle Park, NC (US)

( * ) Notice: Subject to any disclaimer, the term of this patent is extended or adjusted under 35 U.S.C. 154(b) by 0 days.

(21) Appl. No.: 10/139,527

(22) Filed: May 6, 2002

(65) Prior Publication Data

US 2004/0017644 A1 Jan. 29, 2004

Related U.S. Application Data

(60) Provisional application No. 60/331,376, filed on Sep. 7, 2001.

(51) Int. Cl.[7] ..... H02N 13/00
(52) U.S. Cl. ..... 361/233; 200/181; 361/207
(58) Field of Search ..... 335/78, 80, 128; 200/181, 512, 113; 361/230–235

(56) References Cited

U.S. PATENT DOCUMENTS

| | | | |
|---|---|---|---|
| 3,772,537 | A | 11/1973 | Clifford et al. |
| 3,989,357 | A | 11/1976 | Kalt |
| 4,094,590 | A | 6/1978 | Kalt |
| 4,266,339 | A | 5/1981 | Kalt |
| 4,480,162 | A | 10/1984 | Greenwood |
| 4,516,091 | A | 5/1985 | Sasser |
| 4,620,123 | A | 10/1986 | Farrall et al. |
| 4,620,124 | A | 10/1986 | Farrall et al. |
| 4,626,698 | A | 12/1986 | Harnden, Jr. et al. |
| 4,736,202 | A | 4/1988 | Simpson et al. |
| 4,782,313 | A | 11/1988 | Brant, Jr. |
| 4,811,246 | A | 3/1989 | Fitzgerald, Jr. et al. |
| 4,893,048 | A | 1/1990 | Farrall |
| RE33,568 | E | 4/1991 | Harnden, Jr. et al. |
| RE33,577 | E | 4/1991 | Harnden, Jr. et al. |
| RE33,587 | E | 5/1991 | Harnden, Jr. et al. |
| RE33,618 | E | 6/1991 | Harnden, Jr. et al. |

(List continued on next page.)

FOREIGN PATENT DOCUMENTS

| | | |
|---|---|---|
| DE | 38 09 597 A1 | 10/1989 |
| DE | 4305033 A1 | 10/1993 |
| DE | 4437260 C1 | 10/1995 |
| WO | WO 01/01434 | 1/2001 |
| WO | WO 01/01434 A1 | 1/2001 |
| WO | WO 01/09911 A1 | 2/2001 |

OTHER PUBLICATIONS

M. Elwenspoek, L. Smith, B. Hök; *Active Joints for Microrobot Limbs; J. Micromech. Microeng*; 2 ; 1992; pp. 221–223; IOP Publishing Ltd. UK. no month.

(List continued on next page.)

*Primary Examiner*—Lincoln Donovan
(74) *Attorney, Agent, or Firm*—McDermott, Will & Emery

(57) ABSTRACT

A MEMS (Micro Electro Mechanical System) electrostatically operated high voltage switch or relay device is provided. These devices can switch high voltages while using relatively low electrostatic operating voltages. The MEMS device comprises a substrate, a substrate electrode, and one or more substrate contacts. The MEMS device also includes a flexible composite overlying the substrate, one or more composite contacts, and at least one insulator. The switch or relay device is provided overdrive potential through protrusions on the contact surface of the switch or relay contacts. In one embodiment the substrate contacts define protrusions on the contact surface that extend toward the flexible composite contacts. In another embodiment the flexible composite contacts define protrusions on the contact surface that extend toward the substrate contacts.

26 Claims, 5 Drawing Sheets

U.S. PATENT DOCUMENTS

| | | | | | |
|---|---|---|---|---|---|
| RE33,691 | E | | 9/1991 | Harnden, Jr. et al. | |
| 5,233,459 | A | | 8/1993 | Bozler et al. | |
| 5,258,591 | A | | 11/1993 | Buck | |
| 5,367,136 | A | | 11/1994 | Buck | |
| 5,367,584 | A | | 11/1994 | Ghezzo et al. | |
| 5,463,233 | A | | 10/1995 | Norling | |
| 5,467,067 | A | | 11/1995 | Field et al. | |
| 5,467,068 | A | | 11/1995 | Field et al. | |
| 5,578,976 | A | | 11/1996 | Yao | |
| 5,619,061 | A | | 4/1997 | Goldsmith et al. | |
| 5,638,946 | A | | 6/1997 | Zavracky | |
| 5,723,894 | A | | 3/1998 | Ueno et al. | |
| 5,808,527 | A | | 9/1998 | De Los Santos | |
| 5,834,975 | A | | 11/1998 | Bartlett et al. | |
| 5,872,489 | A | | 2/1999 | Chang et al. | |
| 5,880,921 | A | | 3/1999 | Tham et al. | |
| 5,930,165 | A | | 7/1999 | Johnson et al. | |
| 5,955,817 | A | | 9/1999 | Dhuler et al. | |
| 6,046,659 | A | * | 4/2000 | Loo et al. | 333/262 |
| 6,067,183 | A | | 5/2000 | Furlani et al. | |
| 6,127,908 | A | | 10/2000 | Bozler et al. | |
| 6,175,443 | B1 | | 1/2001 | Aksyuk et al. | |
| 6,184,065 | B1 | * | 2/2001 | Smith et al. | 438/117 |
| 6,223,088 | B1 | | 4/2001 | Scharnberg et al. | |
| 6,229,683 | B1 | | 5/2001 | Goodwin-Johansson | |
| 6,229,684 | B1 | | 5/2001 | Cowen et al. | |
| 6,236,491 | B1 | | 5/2001 | Goodwin-Johansson | |
| 6,239,685 | B1 | | 5/2001 | Albrecht et al. | |

OTHER PUBLICATIONS

M. Elwenspoek, M. Weustink, R. Legtenberg; *Static and Dynamic Properties of Active Joints; Transducers '95 —Eurosensors IX*; 1995; pp. 412–415; 337—PB 11 The 8$^{th}$ International Conference on Solid State Sensors and Actuators, and Eurosensors IX Stockholm, Sweden. no month.

Rob Legtenberg, Erwin Berenschot, Miko Elwenspoek, Jan Fluitman; *Electrostatic Curved Electrode Actuators; Proceedings IEEE Micro Electro Mechanical Systems*; 1995; pp. 37–42; IEEE; Catalog No. 95CH35754. no month.

J.Haji–Babaer; C.Y. Kwok; R.S. Huang; *Integrable Active Microvalve with Surface Micromachined Curled–Up Actuators; Tranducers '97*; pp. 833–836; 1997 International Conference on Solid–State Sensors and Actuators, Chicago; IEEE. no month.

* cited by examiner

OVERDRIVE STRUCTURES FOR FLEXIBLE ELECTROSTATIC SWITCH

CROSS REFERENCE TO RELATED APPLICATIONS

The present application claims priority from U.S. Provisional Patent Application No. 60/331,376, entitled Overdrive Structures for Flexible Electrostatic Switch filed on Sep. 7, 2001, the contents of which are incorporated herein by reference.

FIELD OF THE INVENTION

The present invention relates to microelectromechanical switch and relay structures, and more particularly to overdrive structures to be used in conjunction with electrostatically activated switch and relay structures.

BACKGROUND OF THE INVENTION

Advances in thin film technology have enabled the development of sophisticated integrated circuits. This advanced semiconductor technology has also been leveraged to create MEMS (Micro Electro Mechanical System) structures. MEMS structures are typically capable of motion or applying force. Many different varieties of MEMS devices have been created, including microsensors, microgears, micromotors, and other microengineered devices. MEMS devices are being developed for a wide variety of applications because they provide the advantages of low cost, high reliability and extremely small size.

Design freedom afforded to engineers of MEMS devices has led to the development of various techniques and structures for providing the force necessary to cause the desired motion within microstructures. For example, microcantilevers have been used to apply rotational mechanical force to rotate micromachined springs and gears. Electromagnetic fields have been used to drive micromotors. Piezoelectric forces have also successfully been used to controllably move micromachined structures. Controlled thermal expansion of actuators or other MEMS components has been used to create forces for driving microdevices. One such device which leverages thermal expansion to move a microdevice is found in U.S. Pat. No. 5,475,318, entitled "Microprobe", issued on Dec. 12, 1995, in the name of inventors Marcus et. al. In that device a micro cantilever is constructed from materials having different thermal coefficients of expansion; When heated, the bimorph layers arch differently, causing the micro cantilever to move accordingly. A similar mechanism is used to activate a micromachined thermal switch as described in U.S. Pat. No. 5,463,233, entitled "Micromachined Thermal Switch", issued on Oct. 31, 1995, in the name of inventor Norling.

Electrostatic forces have also been used to move structures. Traditional electrostatic devices were constructed from laminated films cut from plastic or Mylar materials. A flexible electrode was attached to the film, and another electrode was affixed to a base structure. Electrically energizing the respective electrodes created an electrostatic force attracting the electrodes to each other or repelling them from each other. A representative example of these devices is found in U.S. Pat. No. 4,266,339, entitled "Method for Making Rolling Electrode for Electrostatic Device", issued on May 12, 1981, in the name of inventor Kalt. These devices work well for typical motive applications, but these devices cannot be constructed in dimensions suitable for miniaturized integrated circuits, biomedical applications, or MEMS structures.

Micromachined MEMS electrostatic devices have been created which use electrostatic forces to operate electrical switches and relays. Various MEMS relays and switches have been developed which use relatively rigid cantilever members separated from the underlying substrate in order to make and break electrical connections. Typically, contacts at the free end of the cantilever within these MEMS devices move as the cantilever deflects, so that electrical connections may be selectively established. As such, when the contacts are connected in these MEMS devices, most of the cantilever remains separated from the underlying substrate. For instance, U.S. Pat. No. 5,367,136, entitled "Non-Contact Two Position Microelectronic Cantilever Switch", issued on Nov. 22, 1994, in the name of inventor Buck; U.S. Pat. No. 5,544,001, entitled "Electrostatic Relay", issued on Aug. 6, 1996, in the name of inventors to Ichiya, et al., and U.S. Pat. No. 5,278,368, entitled "Electrostatic Relay", issued Jan. 11, 1994, in the name of inventors Kasano, et al. are representative of this class of microengineered switch and relay devices.

Another class of micromachined MEMS switch and relay devices include curved cantilever-like members for establishing electrical connections. For instance, U.S. Pat. No. 5,673,785, entitled "Micromechanical Relay", issued on Oct. 7, 1997, in the name of inventors Schlaak, et al., describe a microcantilever that curls as it separates from the fixed end of the cantilever and then generally straightens. The electrical contact is disposed at the generally straight free end of the microcantilever. When electrostatically attracted to a substrate electrode, the Schlaak devices conform substantially to the substrate surface except where the respective electrical contacts interconnect. In addition, a technical publication by Ignaz Schiele et al., titled Surface-Micromachined Electrostatic Microrelay, 1198, Sensors and Actuators, also describes micromachined electrostatic relays having a curled cantilever member. The Schiele cantilever initially extends parallel to the underlying substrate as it separates from the fixed end before curling away from the substrate. While the cantilever member having a contact comprises a multilayer composite, flexible polymer films are not used therein. As such, the Schiele devices do not describe having the cantilever member conform substantially to the underlying substrate in response to electrostatic actuation thereof.

MEMS electrostatic switches and relays are used advantageously in various applications because of their extremely small size. Electrostatic forces due to the electric field between electrical charges can generate relatively large forces given the small electrode separations inherent in MEMS devices. However, problems may arise when these miniaturized devices are used in high voltage applications. Because MEMS devices include structures separated by micron scale dimensions, high voltages can create electrical arcing and other related problems. In effect, the close proximity of contacts within MEMS relays and switches multiplies the severity of these high voltage problems. Further, relatively high electrostatic voltages are required to switch high voltages. The air gap separation between the substrate electrode and moveable cantilever electrode affects the electrostatic voltage required to move the cantilever electrode and operate the switch or relay. A relatively large air gap is beneficial for minimizing high voltage problems. However, the larger the air gap, the higher the voltage required to operate the electrostatic switch or relay. As such, traditional MEMS electrostatic switch and relay devices are not well suited for high voltage switching applications.

Recent innovations have led to MEMS switches and relays that leverage the benefits of electrostatic forces and provide for devices capable of switching high voltages with relatively low electrostatic voltages. Additionally, these devices have shown to be instrumental in overcoming at least some of the arcing and high voltage operational problems. See for example, U.S. patent application Ser. No. 09/345,722, entitled "High Voltage Micromachined Electrostatic Switch", filed on Jun. 30, 1999, in the name of inventor Goodwin-Johansson and assigned to the same assignee, MCNC, as the present invention. That application is expressly incorporated by reference as if fully setforth herein. A key attribute to the structures discussed in the aforementioned application is the availability of large electrostatic forces due to the flexible metallized polymer film coming into direct contact with the substrate that contains the stationary electrode.

In the switches and relays discussed in the Goodwin-Johansson '722 Application the switch contacts that are disposed in the substrate are typically designed as posts that extend slightly above the surface of the substrate structure. The release layer operation employed during switch fabrication generally results in the posts having a flat plan view topography. As such, the majority of the area of the contact in the flexible composite is generally the same spacing from the substrate contacts as the rest of the flexible composite is from the substrate. As a result of this equal spacing, when the switch closes (i.e. the entirety of the flexible composite lies generally parallel with the substrate) minimal contact force results between the substrate contacts and the flexible composite contacts. This lack of overdrive capability can result in unacceptable contact resistances. What is needed are contact structures within the MEMS electrostatic switching and relay devices that are capable of imparting overdrive capabilities and insuring sufficient contact force between the substrate contacts and the flexible composite contacts.

SUMMARY OF THE INVENTION

The present invention provides improved MEMS electrostatic switch and relay devices that can provide overdrive potential to the contacts by adding surface topography to the mating surfaces of the contacts. Further, a method for using the MEMS electrostatic switch and/or relay device according to the present invention is provided.

A MEMS device driven by electrostatic forces according to the present invention comprises a substrate, at least one substrate electrode, at least one substrate contact, a flexible composite, at least one flexible composite contact, and an insulator. A substrate defines a planar surface upon which the MEMS device is constructed. The substrate electrode(s) typically forms a layer on the surface of the substrate. The flexible composite generally overlies the substrate electrode (s). In cross section, the flexible composite comprises an electrode element layer and at least one biasing element layer. The flexible composite across its length comprises a fixed portion attached to the underlying substrate, and a distal portion moveable with respect to the substrate electrode. The composite contact is attached to the composite. In addition, an insulator electrically isolates and separates the substrate electrode from the electrode layer of the flexible composite. Applying a voltage between the substrate electrode and flexible composite electrode creates an electrostatic force that attracts the moveable distal portion of the composite to the underlying substrate. As such, the substrate contact and composite contact are electrically connected together in response to the application of electrostatic force.

In one embodiment of the invention the at least one substrate contact will define protrusions on the contact surface that extend toward the at least one flexible composite contact. The protrusions on the surface of the contacts add topography to the contacts and provide for overdrive potential when the contacts are brought into contact. The protrusions allow for greater contact force over a larger surface area between the contacts, and lower contact resistance.

In another embodiment of the invention the at least one flexible composite contact will define protrusions on the contact surface that extend toward the at least one substrate contact. Similarly, the protrusions on the surface of the contacts add topography to the contacts and provide for overdrive potential when the contacts are brought into contact. The protrusions allow for greater contact force over a larger surface area between the contacts, and lower contact resistance.

One embodiment of the MEMS electrostatic device according to the present invention forms the electrode element and biasing element of the flexible composite from one or more generally flexible materials. Layers comprising the composite can be selected such that the flexible composite substantially conforms to the surface of the substrate when the distal portion of the flexible composite is attracted to the substrate. In addition, layers comprising the composite can be selected such that the distal portion can be positionally biased with respect to the substrate when no electrostatic force is applied. Other embodiments define the relative positions of the substrate contact and the substrate surface, as well as the characteristics of the surface of the substrate contact. One embodiment provides a plurality of substrate contacts, which optionally may be interconnected in series or in parallel. The position of the insulator relative to the substrate electrode, substrate contact, and substrate is further defined in one embodiment. One embodiment describes the characteristics of the electrode layer and biasing layers comprising the flexible composite.

In a further embodiment, the characteristics of the distal portion of the flexible composite are described. One embodiment describes the attributes of, and positions of, the composite contact relative to the flexible composite. Further, in one embodiment, the composite contact comprises a plurality of contacts, which optionally may be connected in series or in parallel. An embodiment also details the shapes and relative sizes of the substrate electrode and composite electrode. Other embodiments further comprise a source of electrical energy and electrically connected to at least one of the substrate contact and the composite contact, or electrically connected to at least one of the substrate electrode and the composite electrode. Optionally, these embodiments may further include a diode or a switching device.

In addition, another embodiment of the present invention provides a method of using the electrostatic MEMS devices described above. The method comprises the step of electrically isolating at least one of the substrate contact or the composite contact from its respective associated substrate electrode or composite electrode. The method comprises the step of selectively generating an electrostatic force between the substrate electrode and the electrode layer of the flexible composite, and moving the flexible composite toward the substrate. Lastly, the method comprises the step of electrically connecting substrate contact and the flexible composite contact in a circuit and overdriving the flexible composite contact or substrate contact into the corresponding substrate contact or flexible composite contact so as to minimize contact resistance.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
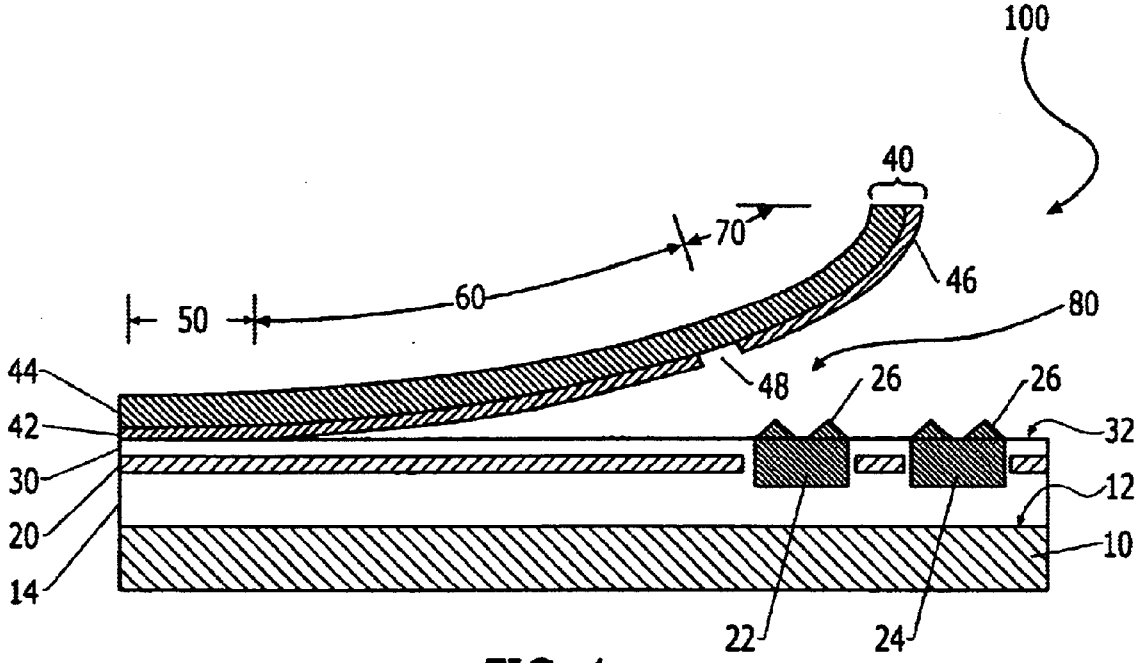
FIG. 1 is a cross-sectional view of a MEMS electrostatic switch/relay device having overdrive structures on the surface of the substrate contacts in accordance with an embodiment of the present invention.

Referring to FIG. 1, shown is a cross-sectional view of a MEMS switch/relay device 100 driven by electrostatic forces that can provide overdrive capabilities to switch high voltages while using relatively lower electrostatic operating voltages, in accordance with an embodiment of the present invention. In a first embodiment, an electrostatic MEMS switch/relay device comprises in layers, a substrate 10, a substrate electrode 20, a substrate insulator 30, and a flexible composite 40. One or more substrate contacts, for example substrate contacts 22 and 24 are attached to the substrate. The substrate contacts define protrusions 26 that extend beyond the generally planar surface of the substrate insulator and provide overdrive capabilities for the switch. The flexible composite is generally planar and overlies the substrate and substrate electrode. The layers are arranged and shown vertically, while the portions are disposed horizontally along the flexible composite. In cross section, the flexible composite 40 comprises multiple layers including at least one electrode element 42 layer and at least one biasing element 44 layer. Additionally, the flexible composite will comprise at least one flexible composite contact 46 that acts to provide switching or relay capabilities in conjunction with the substrate contact(s).

Along its length, the flexible composite has a fixed portion 50, a medial portion 60, and a distal portion 70. The fixed portion is substantially affixed to the underlying substrate or intermediate layers. The medial portion and distal portion are released from the underlying substrate, and in operation preferably both portions are flexible with respect to the underlying substrate and substrate electrode. The medial portion extends from the fixed portion and is biased or held in position without the application of electrostatic force. The distal portion extends from the medial portion, and is also biased or held in position without the application of electrostatic force. However, in some embodiments, the medial portion may be held in position whether or not electrostatic force is applied, such that only the distal portion is free to move in operation. An air gap 80 is defined between the medial portion, distal portion, and the planar surface of the underlying substrate. The air gap results from a release layer operation during fabrication of the device. By predefining the shape of the air gap, recently developed MEMS electrostatic devices can operate with lower and less erratic operating voltages. See for example, U.S. patent application Ser. No. 09/320,891, entitled "Micromachined Electrostatic Actuator with Air Gap" filed on May 27, 1999, in the name of inventor Goodwin-Johansson and assigned to MCNC, the assignee of the present invention, describing these improved electrostatic devices having a predefined air gap. That application is herein incorporated by reference as if setforth fully herein.

The electrostatic MEMS switch/relay device, including the flexible composite and underlying substrate layers, is constructed using known integrated circuit materials and microengineering techniques. Those skilled in the art will understand that different materials, various numbers of layers, and numerous arrangements of layers may also be used to form the underlying substrate layers. Although the MEMS device switch/relay illustrated in the figures will be used as an example to describe manufacturing details, this discussion applies equally to all MEMS switch/relay devices provided by the present invention unless otherwise noted.

Referring once again to FIG. 1, a substrate 10 defines a planar surface 12 upon which the electrostatic MEMS switch/relay device is constructed, in accordance with an embodiment of the present invention. Preferably the substrate comprises a silicon wafer, although any suitable substrate material having a planar surface can be used. Other semiconductors, glass, plastics, or other suitable materials may serve as the substrate. An insulating layer 14 typically overlies the planar surface of the substrate and provides electrical isolation. The insulating layer preferably comprises a non-oxidation based insulator or polymer, such as polyimide or nitride. In this case, oxide based insulators are avoided if certain acids (such as hydrofluoric) are used in processing to remove the release layer. Other insulators, even oxide based insulators, may be used if release layer materials and compatible acids or etchants are used for removing the release layer. For instance, silicon dioxide could be used for the insulating layers if etchants not containing hydrofluoric acid are used. The insulating layer is preferably formed by using a conventional spin-on technique to deposit a suitable material on the planar surface of the substrate.

A substrate electrode 20 is disposed as a generally planar layer affixed to at least a portion of the surface of the underlying insulating layer 14. The substrate electrode preferably comprises a gold layer deposited on the top surface of the insulating layer. If the substrate electrode is formed from a layer of gold, optionally a thin layer of adhesion promoting material, such as chromium, may be deposited adjacent to either side of the substrate electrode layer to allow better adhesion to the insulating layer and any adjacent materials. Alternatively, other metallic or conductive materials may be used as the substrate electrode material so long as release layer processing operations does not erode them. The substrate electrode material is typically disposed using a conventional PVD or CVD deposition technique and the substrate electrode is patterned and etched using standard photolithography techniques.

Preferably, a substrate insulating layer 30 is deposited on the substrate electrode 20 to electrically isolate the substrate electrode and prevent electrical shorting. Further, the substrate insulating layer provides a dielectric layer of predetermined thickness between the substrate electrode 20 and the flexible composite 40, including the flexible electrode element 44. The second insulating layer 30 preferably comprises polyimide, although other dielectric insulators or polymers tolerant of release layer processing may also be used. The second insulating layer 30 has a generally planar surface 32. The second insulating layer is typically disposed by using a conventional spin-on technique or any other suitable deposition technique may be used to form the second insulating layer.

Substrate contacts 22 and 24 are attached to the substrate. Each substrate contact is preferably formed from a conductive layer, such as gold. Alternatively, if gold contacts are used a thin layer of adhesion promoting material, such as chromium, may be deposited onto the gold contacts to allow better adhesion to the adjacent insulating materials. However, other metallic or conductive materials can be used for the substrate contacts so long as they are not eroded by processing used to remove the release layer. Preferably, each substrate contact is electrically isolated and insulated from the substrate electrode 20 and any other substrate contacts, such that arcing and other high voltage problems are minimized.

The substrate contacts can be formed using various conventional fabrication techniques. For instance, the substrate contacts may be formed by disposing a conductive layer on the insulating layer 14 prior to depositing the layer that forms the substrate electrode 20. Alternately, the layer that forms the substrate electrode may be used to form the substrate contacts. In some instances, additional conductive material may be required to be deposited on those areas of the substrate electrode layer that define the substrate contacts, so that the substrate contacts protrude above the substrate electrode. In other instances, it may be feasible to construct the substrate contacts generally flush with the substrate electrode and, as such, no further build-up of conductive material would be warranted. Additionally, in those embodiments that implement a second insulating layer 30 it may be necessary to create openings in the second insulating layer at the regions that define the substrate contacts and, subsequently, deposit the conductive material that will form the contacts in the openings.

Figure 2:
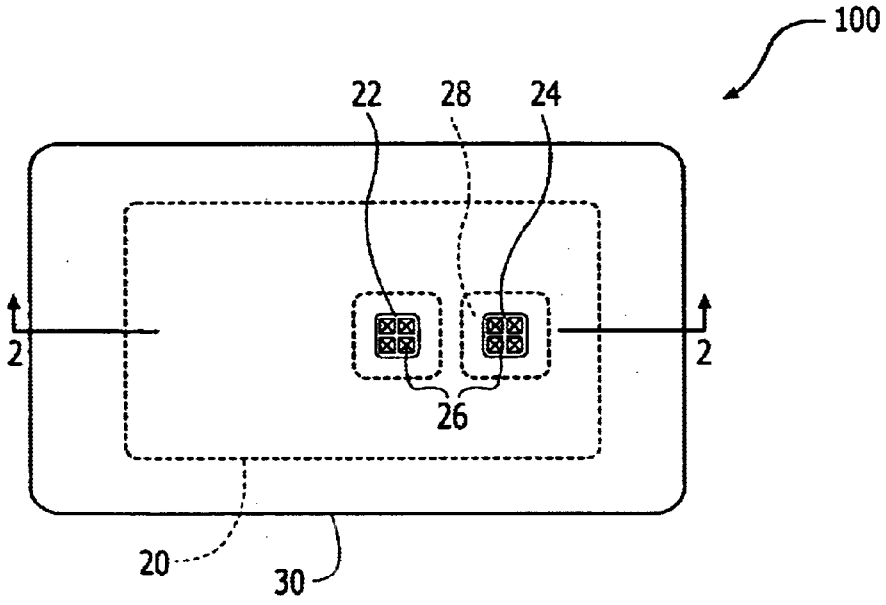
FIG. 2 is a top plan view of the substrate construct of a MEMS electrostatic switch/relay device having overdrive structures on the surface of the substrate contacts in accordance with an embodiment of the present invention.

Referring to FIG. 2, shown is a plan view of the substrate construct of the MEMS switch/relay device, in accordance with the present invention. As FIG. 2 illustrates, an insulating gap 28 is provided to surround and insulate substrate contacts 22 and 24 accordingly. In this embodiment, the insulating gap preferably comprises the second insulating layer 30 material, although air or other insulators can be used therein. In addition, the substrate electrode preferably surrounds at least part of the insulating gap around each substrate contact, such that the flexible composite can be electrostatically attracted over and firmly contact the entire surface area of the substrate contact.

In one embodiment of the invention the substrate contacts 22 and 24 define protrusions 26 that are formed on the surface of the contacts and protrude toward the flexible composite 40. The protrusions may be a series of mounds or any other shaped structure that adds topography to the surface of the contact. The protrusions serve to provide overdrive potential for the substrate contact(s) 22 and 24 and flexible composite contact(s) 46 when electrostatic voltage is provided and the flexible composite is moved toward the substrate. In this sense, the protrusions may provide the impetus for the substrate contact(s) to break through any barrier layer (oxide) on the flexible composite contact and maximize the overall contact surface area, thereby lowering undesirable contact resistances. The protrusions may be formed by any known processing technique that is capable of providing topography to the exposed surface of the contact. Preferably, the protrusions may be formed by a patterned subtractive etch of the underlying contact or a separate lift-off deposition process may be used to form the protrusions. The protrusions will typically be formed of the same conductive material as the underlying contact. The protrusions may be formed as a systemized patterned array or the protrusions may be formed randomly on the contacts. In one embodiment, the protrusions are formed in a ring-like array along the perimeter of the contact, so as to maximize the number of protrusions that make contact with the flexible composite. The protrusion need not be large in height to effect the required overdrive action, typically the protrusions will be about 20 to about 100 nanometers in height.

Figure 3:
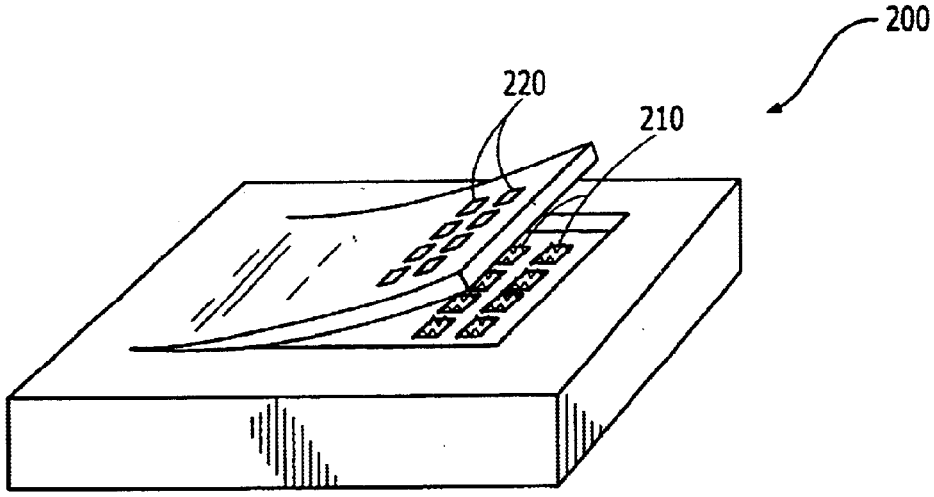
FIG. 3 is a perspective view of a MEMS electrostatic switch/relay device having overdrive structures on the surface of a plurality of substrate contacts in accordance with an embodiment of the present invention.

The substrate contact(s) 22 and 24 can be customized as required for a given switch or relay application. The quantity and positioning of the contacts on the substrate will vary according to the application for which the switch/relay will be implemented. For instance, a single substrate contact may be provided in some switches or relays for selectively connecting complimentary flexible composite contacts disposed on the flexible composite. Alternatively, a plurality of substrate contacts may be provided. See for example FIG. 3, a perspective view of a MEMS electrostatic switching device 200 having multiple substrate contacts 210 with overdrive protection and corresponding flexible composite contacts 220, in accordance with an embodiment of the present invention. In some embodiments, it may be advantageous to electrically connect at least two of the plurality of substrate contacts in series. In alternate embodiments, it may be advantageous to connect at least two of the plurality of substrate contacts in parallel. In other cases, some of the plurality of substrate contacts may be connected in series and some may be connected in parallel, as required.

Figure 4:
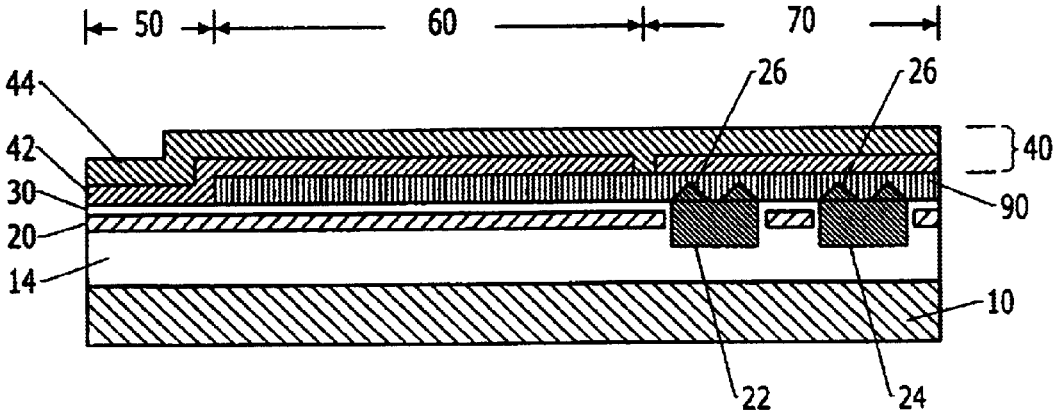
FIG. 4 is a cross-sectional view of a fabrication stage of a MEMS electrostatic switch/relay device having overdrive structures on the surface of the substrate contacts highlighting the release layer formation, in accordance with an embodiment of the present invention.

Prior to forming the flexible composite structure, a release layer is first deposited on the planar surface 32 of the substrate construct in the area underneath the medial 60 and distal 70 portions of the overlying flexible composite 40. The release layer 90 is shown in FIG. 4 and occupies the space shown as the air gap 80 in FIG. 1. The release layer is only patterned and applied to areas below flexible composite portions not being affixed to the underlying planar surface. Preferably, the release layer comprises an oxide or other suitable material that may be etched away when acid is applied thereto. A conventional deposition technique, such as PVD or CVD, is typically used to deposit the release layer followed by a standard pattern and etch procedure. In the embodiment in which the protrusions are formed on the substrate contacts, the surface of the release layer that contacts the flexible composite will be generally planar so as to impart a generally planar surface on the composite contacts. The planar surface of the composite contacts is typically necessary so that the overdrive resulting from the protrusions can force the substrate and composite contacts together and not be limited by the contacting of the surrounding areas.

After the overlying layers of the flexible composite have been deposited, the release layer may be removed through standard microengineering acidic etching techniques, such as a hydrofluoric acid etch. When the release layer has been removed, the medial portion 60 and distal portion 70 of flexible composite 40 are separated from the underlying planar surface 32, creating the air gap 80 there between. The shape of the air gap is determined according to the bias provided to the distal portion and/or medial portion of the flexible composite when no electrostatic force is applied. In one embodiment, the air gap decreases throughout the distal and medial portions and gradually ends where the fixed portion of the flexible composite contacts the underlying substrate, as shown in FIG. 1. In another embodiment of the present invention, shown in FIG. 5, the air gap 80 decreases from the distal portion 70 to the medial portion 60, has a generally constant width underlying the medial portion 60, and then ends abruptly where the fixed portion 50 contacts the underlying substrate construct.

The layers of the flexible composite 40 generally overlie the planar surface 32 of the substrate construct. At a minimum, two layers comprise the flexible composite 40, one layer comprises the flexible electrode element 42 and one layer comprises the biasing element 44 which is disposed on either side of the flexible electrode element. The biasing element preferably comprises a polymer film and is used to hold the flexible composite in a given position with respect to the underlying planar surface, absent electrostatic forces. Optionally, an additional biasing layer (not shown in the FIGS) may be provided for that overlies at least part of the area defined by the release layer and the exposed planar surface 32. This additional layer will typically comprise a polymer material capable of providing insulation to the flexible electrode element 42 layer from the underlying substrate electrode 20 or additional positional biasing. While polyimide is the preferred polymer film for forming the biasing element, many other flexible polymers suitable for release layer fabrication processes may also be used.

Flexible electrode element 42 preferably comprises a layer of flexible conductor material, such as gold, which is deposited overlying the planar surface 32 of the substrate construct. A standard deposition technique is used to form the flexible electrode element layer and conventional photolithography and etching techniques are used to form the flexible electrode element. The flexible electrode element may be positioned directly adjacent to the planar surface or, as discussed above, an optional biasing/insulating layer may be disposed between the flexible electrode element and the substrate construct, as needed. The flexible electrode 42 preferably comprises gold, although other conductors tolerant of release layer processing and flexible, such as conductive polymer film, may be used. If gold is used to form the flexible electrode, a thin layer of adhesion promoting material, such as chromium, may be deposited onto the flexible electrode element to allow better adhesion of the gold to the adjacent materials, such as to one or more layers of polymer film. The surface area and/or configuration of flexible electrode element 42 can be varied as required to create the desired electrostatic forces to operate the high voltage MEMS device. Typically, the biasing element 44 will comprise a layer that overlies at least a portion of the flexible electrode element. The biasing element will typically comprise a flexible polymer, such as polyimide. The biasing element is typically deposited using a standard deposition technique, such as low-pressure chemical vapor deposition (LPCVD) or suitable spin-on processes. Optionally, additional biasing layers (not shown in FIG. 1) may be applied overlying at least a portion of the flexible electrode element 42 and biasing element 44. As before, the additional biasing layers will typically comprise a flexible polymer, such as polyimide.

Figure 5:
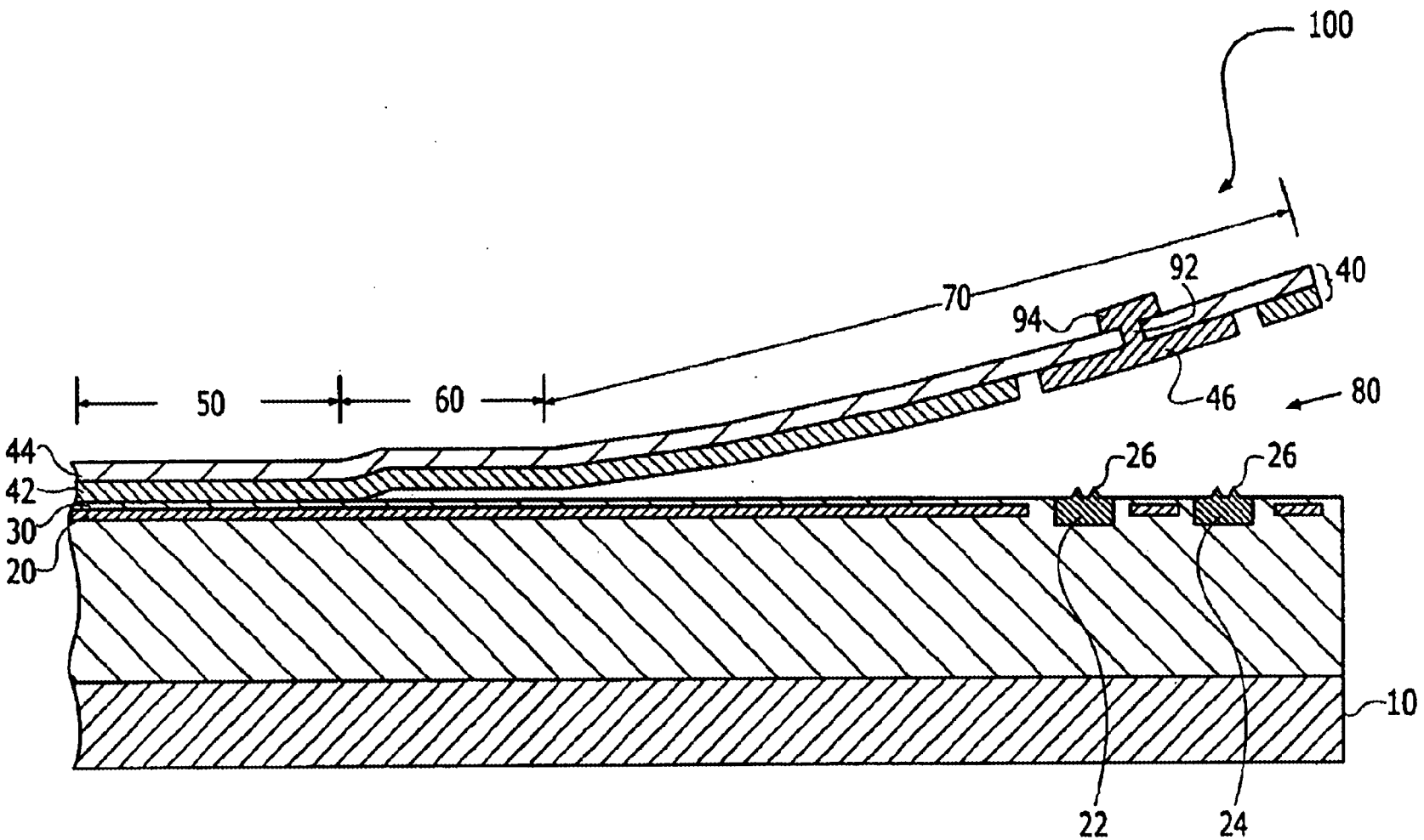
FIG. 5 is a cross-sectional view of a MEMS electrostatic switch/relay device having overdrive structures on the surface of the substrate contacts and alternative biasing of the flexible composite, in accordance with an embodiment of the present invention.

As shown in FIG. 1, the MEMS switch/relay device of the present invention will also include one or more flexible composite contacts 46 within the flexible composite 40. Each flexible composite contact is preferably disposed within the flexible electrode 40 layer. Preferably, one or more flexible composite contacts are formed by patterning and etching the flexible composite electrode layer 42, as shown. Insulating gaps, such as insulating gap 48, serve to electrically isolate the composite contact 46 from the flexible composite electrode 42. While the insulating gaps are preferably filled with air, many other suitable insulators can be used. Like the flexible electrode layer, one or more insulators can be used to insulate and electrically isolate the composite contact(s) from the substrate electrode. For instance, the insulating layer 30, the biasing element 44 layer, or both can be selectively applied as needed to electrically isolate the flexible composite and one or more composite contacts from the underlying substrate electrode 20. Preferably, there is no insulation disposed between one or more flexible composite contacts, such as 42, and one or more substrate contacts, such as 24 and 26. Accordingly, the MEMS device can function as a switch or relay once the substrate and composite contacts are selectively electrostatically connected. Optionally, the flexible composite contact can be adapted to extend through one or more apertures, such as 92 (as shown in FIG. 5), formed in the biasing element 44 layer. In this embodiment, at least a portion of the flexible composite contact extends above the upper biasing element layer so as to provide one or more electrical connections, such as 94. Metal lines (not shown in the FIGS.) may be deposited to connect to the flexible composite contact through the provided electrical connection(s).

Figure 6:
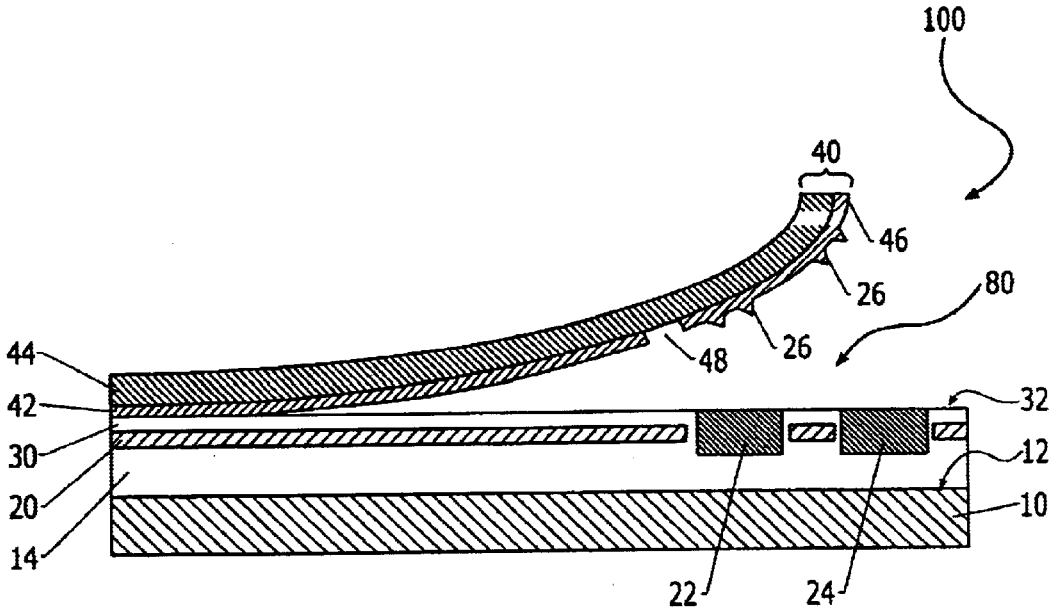
FIG. 6 is a cross-sectional view of a MEMS electrostatic switch/relay device having overdrive structures on the surface of the flexible composite contact, in accordance with an alternate embodiment of the present invention.
Figure 7:
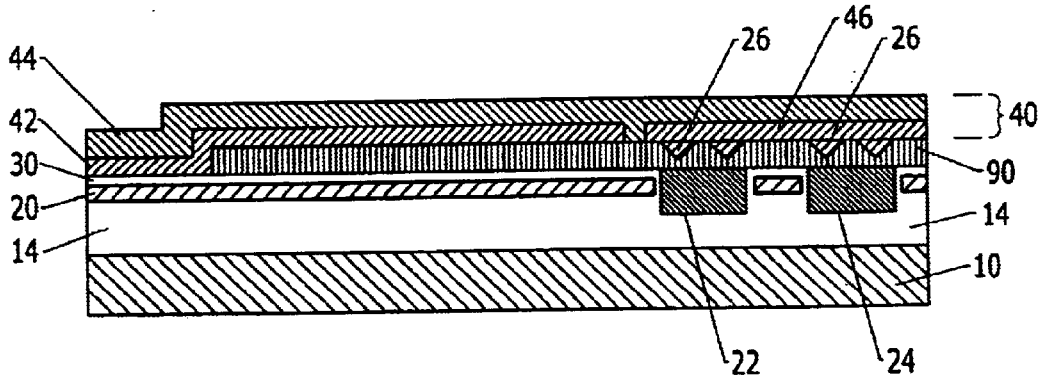
FIG. 7 is a cross-sectional view of a fabrication stage of a MEMS electrostatic switch/relay device having overdrive structures on the surface of the flexible composite contact highlighting the release layer formation, in accordance with an embodiment of the present invention.

FIG. 6 illustrates a cross-sectional view of a MEMS switch/relay device 100 having one or more flexible composite contact(s) 46 defining protrusions 26 that are formed on the surface of the flexible composite contact and protrude toward the substrate construct, in accordance with an embodiment of the present invention. Similar to the protrusions that may be formed on the substrate contacts 22 and 24, the protrusions may be a series of mounds or any other shaped structure that adds topography to the surface of the contact. The protrusions serve to provide overdrive potential for the flexible composite contact(s) and substrate contact(s) when electrostatic voltage is provided and the flexible composite 40 is moved toward the substrate. In this sense, the protrusions may provide the impetus for the flexible composite contact(s) to break through any barrier layer on the substrate contact and maximize the overall contact surface area, thereby lowering undesirable contact resistances. The protrusions may be formed by any known processing technique that is capable of providing topography to the exposed surface of the contact. Preferably, the protrusions may be formed by etching small depressions in the top surface of the release layer 90 (as shown in FIG. 7)

and then disposing the flexible electrode element 42 layer. In doing so, the depressions will be filled by the material used to form the flexible composite contact 46, thereby forming protrusions 26 in the flexible composite contact. The protrusions will typically be formed of the same conductive material as the flexible composite contact. The protrusions may be formed as a systemized patterned array or the protrusions may be formed randomly on the contacts. The protrusion need not be large in height to effect the required overdrive action, typically the protrusions will be about 20 to about 100 nanometers in height.

In addition, the attributes of the flexible composite contact can be customized as required for a given switch or relay application. Single or multiple flexible composite contacts may be provided in some switches or relays according to the present invention. Additionally, in those embodiments in which a plurality of flexible composite contacts exists at least one of the plurality of flexible composite contacts can be electrically isolated from the composite electrode. Further, in one embodiment the composite electrode 42 surrounds at least part of the insulating gap 48 around each composite contact 46, such that the flexible composite 40 can be electrostatically attracted over and firmly contact the entire surface area of the substrate contact. The relative placement of flexible composite contacts (and corresponding substrate contacts) can be varied for different switch or relay applications.

Further, the characteristics of the substrate electrode 20 and composite electrode 42 may be customized as needed for given switch or relay applications. The surface area and shape of the substrate electrode 42 can be varied as required creating the desired electrostatic forces. While the substrate electrode can have varying degrees of overlap with the flexible composite 40, in one embodiment, the substrate electrode underlies substantially the entire area of the distal portion 70 of the flexible composite. The overlap between the substrate electrode and composite electrode can be used to customize the characteristics of the electrostatic device. In one embodiment, the surface area of the substrate electrode comprises generally the same area as the flexible composite electrode. A further embodiment provides a substrate electrode having generally the same shape as the flexible composite electrode. One embodiment provides a flexible composite and the constituent layers having a generally rectangular shape.

The number of layers, thickness of layers, arrangement of layers, and choice of materials used in the flexible composite 40 may be selected to bias the flexible composite as required. In particular, the distal portion 70 and/or the medial portion 60 can be biased as they extend from the fixed portion 50. The biased position of the medial and distal portions can be customized individually or collectively to provide a desired separation from the underlying planar surface 32 and the substrate electrode 20. The distal and medial portions can be biased to remain parallel to the underlying planar surface. Alternatively, the distal and medial portions can be biased to alter the separation from the underlying planar surface by curling toward or curling away from the underlying planar surface. Preferably, the distal portion and optionally the medial portion are biased to curl away from the underlying substrate and alter the separation therefrom. Those skilled in the art will appreciate that more than one biasing element layer may be used, and that the layers may be disposed on either side or both sides of the flexible electrode element layer.

At least one of the layers comprising the flexible composite can function as a composite biasing layer used to bias or urge the flexible composite to curl as required. Preferably, the medial portion 60 and distal portion 70 are biased to curl away from the underlying surface 32, after the release layer has been removed. Providing differential thermal coefficients of expansion between the layers comprising the flexible composite 40 can create bias. Assuming an increase in temperature, the flexible composite will curl toward the layer having the lower thermal coefficient of expansion because the layers accordingly expand at different rates. As such, the flexible composite having two layers with different thermal coefficients of expansion will curl toward the layer having a lower thermal coefficient of expansion as the temperature rises. In addition, two biasing element layers having different thermal coefficients of expansion can be used in tandem with an electrode layer to bias the flexible composite as necessary.

As is known by those of ordinary skill in the art, other techniques may be used to curl the flexible composite 40. For example, different deposition process steps can be used to create intrinsic stresses so as to curl the layers comprising the flexible composite. Further, the flexible composite can be curled by creating intrinsic mechanical stresses in the layers included therein. In addition, sequential temperature changes can be used to curl the flexible composite. For instance, the biasing element layer 44, typically a polymer film, can be deposited as a liquid and then cured by elevated temperatures so that it forms a solid polymer layer. Preferably, a polymer having a higher thermal coefficient of expansion than the electrode element 42 layer can be used. Next, the polymer layer and electrode layer are cooled, creating stresses due to differences in the thermal coefficients of expansion. The flexible composite curls because the polymer layer shrinks faster than the electrode layer.

Further, the relative thickness of the layers comprising the flexible composite 40 and the order in which the layers are arranged can be selected to create bias. In addition, two or more biasing elements 44 of different thickness can be used on either side of the electrode element 42 layer for biasing purposes. For example, the thickness of the flexible composite electrode 42 layer can also be selected to provide bias. As such, the medial portion 60 and distal portion 70 can be positionally biased and urged to curl with respect to the substrate and substrate electrode. In one embodiment, the distal portion of the flexible composite curls out of the plane defined by the upper surface of the flexible composite when no electrostatic force is created between the substrate electrode 20 and the composite electrode layer. Further, the medial portion, the distal portion, or both can be biased to curl with any selected radius of curvature along the span of the portion, such as a variable or constant radius of curvature.

Figure 8:
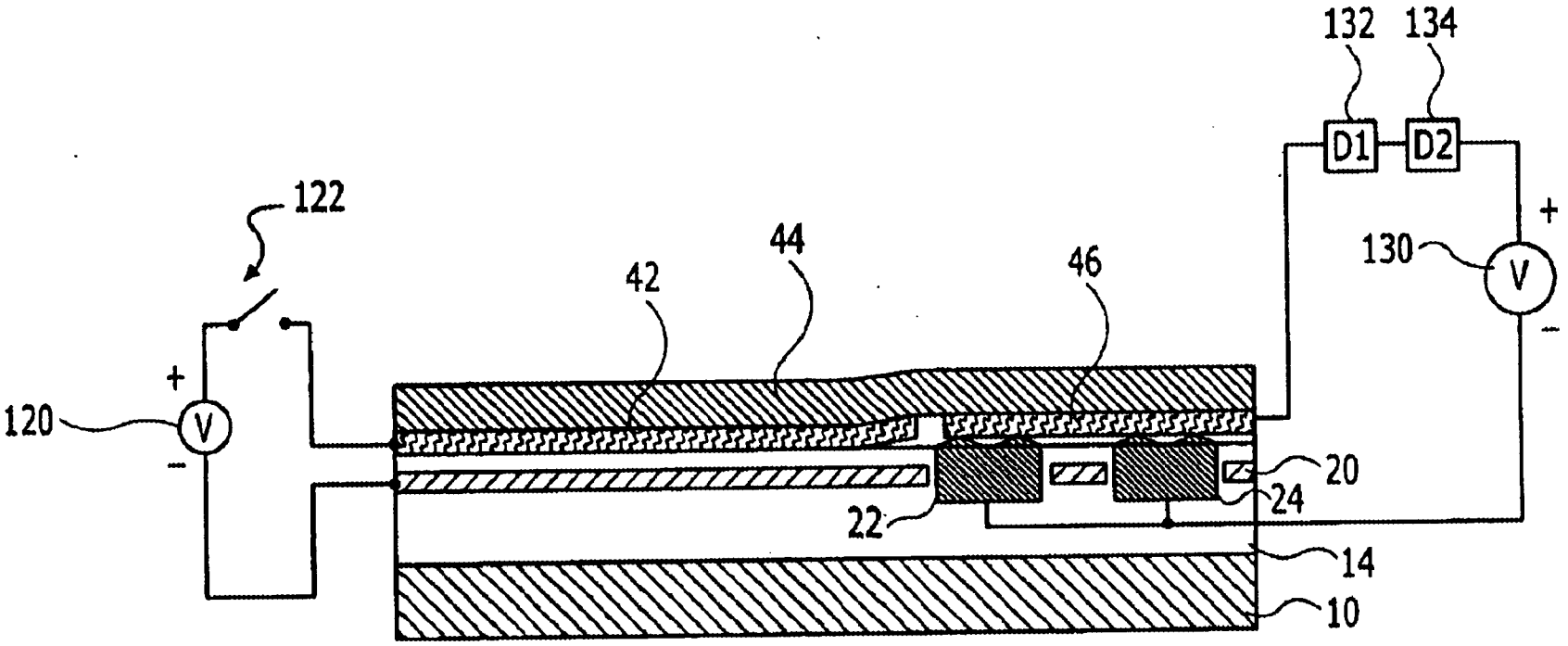
FIG. 8 is a cross-sectional view of a closed-state MEMS electrostatic switch/relay device having overdrive structures on the surface of the flexible composite contact highlighting the implementation of power sources and electrical devices, in accordance with an embodiment of the present invention.

Some embodiments of the MEMS switch/relay device according to the present invention further comprise a source of electrical energy and an optional switch. Shown in FIG. 8 is a cross-sectional view of MEMS electrostatic device with overdrive structures in a closed state, in accordance with an embodiment of the present invention. The source of electrical energy can be any voltage source, current source, or electrical storage device, such as a battery, charged capacitor, energized inductor, or the like. The switching device can be any electrical switch or other semiconductor device used for selectively making and breaking an electrical connection. In one embodiment, a source of electrical energy 120 is connected to the substrate electrode 20, flexible composite electrode 42, or both the substrate electrode and the flexible composite electrode, as shown in FIG. 8. Optionally, a switching device 122 may also be connected to the source of electrical energy, the substrate electrode, the composite electrode, or combinations thereof in the MEMS device. In another embodiment, a source of electrical energy 130 can be connected to the substrate contacts 22 and 24, composite contact 46, or both the substrate contacts and the composite contact, as shown in FIG. 8. In addition, the source of electrical energy 130 and one or more electrical devices, for example D1 and D2 shown as 132 and 134 respectively, are electrically connected through at least one substrate contact, at least one flexible composite contact, or through both types of contacts (as shown in FIG. 8). As such, the source of electrical energy and devices D1 and D2 can be selectively connected when the substrate contact(s) and composite contact(s) are electrically connected in response to the application of electrostatic forces when energy from source 120 is applied to the substrate and composite electrodes, attracting them towards each other. Preferably, an electrical load is connected to the substrate contacts, and the composite contact is used as a shorting bar for interconnecting the electrical load. Those skilled in the art will understand that sources of electrical energy, switching devices, diodes, and electrical loads can be interconnected in various ways without departing from the present invention.

In operation, when no electrostatic force is applied to the substrate electrode 20 and composite electrode 42 the distal portion 70 and optionally the medial portion 60 of the flexible composite are biased in the separated position. Preferably, the portion(s) are biased to curl naturally away and increase the separation from the underlying planar surface 32. As described, the portion(s) of the flexible composite 40 can also be biased in a position parallel to the underlying planar surface of the substrate. In addition, the portion(s) can be biased to alter the separation from the underlying planar surface while extending from the fixed portion 50. The application of electrical charge to the substrate electrode and flexible composite electrode creates an electrostatic attraction between them, causing the movable biased portion(s) to uncurl and conform to the surface of the underlying planar surface. Once the flexible composite is attracted to the underlying surface, the composite contact(s) 46 and substrate contact(s) 22/24 are accordingly electrically connected to complete a circuit, as shown in FIG. 8. Alternatively, the electrostatic force can repel the substrate and flexible electrodes, causing the flexible distal portion to curl away from the planar surface of the substrate. Once electrostatic force is no longer applied between the substrate and flexible electrodes, the distal and medial portions of the flexible composite reassume the separated position due to the bias inherent in the flexible composite. As the distal portion curls, the substrate contact(s) and composite contact(s) are disconnected. The MEMS electrostatic switch and relay according to the present invention can switch voltages from 0.1 to 400 volts, while operating with electrostatic voltages in the range of 30 to 80 volts. Depending on the amount of electrical current switched and the device geometry, other switching voltages and operating voltages can be provided.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limiting the scope of the present invention in any way.

That which is claimed:

1. A MEMS device driven by electrostatic forces, comprising:

a substrate defining a planar surface;

at least one substrate electrode disposed on the surface of said substrate;

at least one substrate contact attached to said substrate and electrically isolated from said at least one substrate electrode;

a flexible composite overlying said at least one substrate electrode and having at least one electrode element and at least one biasing element, said flexible composite having a fixed portion attached to the underlying substrate, and a distal portion movable with respect to said substrate electrode;

at least one flexible composite contact attached to said flexible composite and electrically isolated from said at least one flexible composite electrode element, wherein said at least one flexible composite contact defines protrusions that extend from a contact surface; and an insulator electrically separating said substrate electrode from said flexible electrode, whereby said at least one flexible composite contact and said at least one substrate contact is electrically connected when said flexible composite distal portion is electrostatically attracted to said substrate.

2. The MEMS device according to claim 1, wherein said protrusions on said at least one flexible composite contact serve to provide overdrive potential to said device.

3. The MEMS device according to claim 1, wherein said protrusions on said at least one flexible composite contact form an array pattern on the contact surface of the at least one flexible composite contact.

4. The MEMS device according to claim 1, wherein said protrusions on said at least one flexible composite contact are generally mound-like in shape.

5. The MEMS device according to claim 1, wherein said distal portion of said flexible composite is positionally biased with respect to said substrate.

6. The MEMS device according to claim 1, wherein said at least one substrate contact comprises a plurality of substrate contacts.

7. The MEMS device according to claim 6, wherein at least two of said plurality of substrate contacts are disposed so as to connect in series.

8. The MEMS device according to claim 6, wherein at least two of said plurality of substrate contacts are disposed so as to connect in parallel.

9. The MEMS device according to claim 1, wherein said at least one substrate electrode has a predetermined shape.

10. The MEMS device according to claim 1, wherein said at least one substrate electrode generally underlies the entire area of the distal portion of said flexible composite.

11. The MEMS device according to claim 1, wherein said insulator is attached to and overlies said at least one substrate electrode.

12. The MEMS device according to claim 1, wherein said flexible composite biasing element comprises at least one polymer film.

13. The MEMS device according to claim 1, wherein said flexible composite biasing element comprises polymer films on opposite sides of said flexible composite electrode element.

14. The MEMS device according to claim 1, wherein said flexible composite biasing element and said flexible composite electrode element have different thermal coefficients of expansion, urging said flexible composite to curl.

15. The MEMS device according to claim 1, wherein said flexible composite biasing element comprises at least two polymer films of different thickness, urging said flexible composite to curl.

16. The MEMS device according to claim 1, wherein said flexible composite biasing element comprises at least two polymer films of different coefficients of expansion, urging said flexible composite to curl.

17. The MEMS device according to claim 1, wherein the distal portion of said flexible composite curls out of the plane defined by the upper surface of said flexible composite when no electrostatic force is created between said at least one composite electrode and said at least one flexible composite electrode.

18. The MEMS device according to claim 1, wherein said at least one flexible composite contact comprises a plurality of contacts.

19. The MEMS device according to claim 18, wherein at least two of said plurality of flexible composite contacts are disposed so as to connect in series.

20. The MEMS device according to claim 18, wherein at least two of said plurality of flexible composite contacts are disposed so as to connect in parallel.

21. The MEMS device according to claim 1, wherein said at least one substrate electrode generally encompasses said at least one substrate contact.

22. The MEMS device according to claim 1, wherein said at least one flexible composite electrode layer generally encompasses said at least one flexible composite contact.

23. The MEMS device according to claim 1, further comprising a source of electrical energy electrically connected to at least one of said at least one substrate contacts and one of said at least one flexible composite contacts.

24. The MEMS device according to claim 23, further comprising at least one device electrically connected to at least one of said at least one substrate contacts and one of said at least one flexible composite contacts.

25. The MEMS device according to claim 1, further comprising a source of electrical energy electrically connected to at least one of said at least one substrate electrodes and one of said at least one flexible composite electrodes.

26. The MEMS device according to claim 25, further comprising a switching device electrically connected to at least one of said at least one substrate electrodes and one of said at least one composite electrodes.

* * * * *